US005084217A

United States Patent [19]

Dodds

[11] Patent Number: 5,084,217

[45] Date of Patent: Jan. 28, 1992

[54] APPARATUS AND METHOD FOR CONTROLLING THE DISCHARGE OR CONTINUOUS BLEED-OFF OF THE COOLING WATER OF EVAPORATIVE COOLERS

[76] Inventor: Diego E. F. Dodds, Guiraldes 687, Acassuso (1641), Buenos Aires, Argentina

[21] Appl. No.: 569,134

[22] Filed: Aug. 17, 1990

[30] Foreign Application Priority Data

Nov. 28, 1989 [AR] Argentina ..... 315564

[51] Int. Cl.[5] ..... B01F 3/04

[52] U.S. Cl. ..... 261/36.1; 261/97; 261/DIG. 11; 137/244

[58] Field of Search ..... 261/DIG. 46, 36.1, 97, 261/DIG. 11; 137/244

[56] References Cited

U.S. PATENT DOCUMENTS

| | | | |
|---|---|---|---|
| 2,181,956 | 12/1939 | Woolley | 137/244 |
| 2,287,147 | 6/1942 | Stratton | 261/DIG. 46 |
| 2,859,766 | 11/1958 | Shuldener | 261/DIG. 46 |
| 3,456,927 | 7/1969 | Martin et al. | 261/DIG. 46 |
| 3,773,307 | 11/1973 | Karlsson | 261/DIG. 46 |
| 4,006,843 | 2/1977 | Martinez | 137/244 |
| 4,573,490 | 3/1986 | Kaletsky | 261/DIG, 46 |

*Primary Examiner*—Tim Miles
*Attorney, Agent, or Firm*—Jim Zegeer

[57] ABSTRACT

Method and apparatus for controlling the discharge or continuous bleed-off of cooling water of evaporative coolers and cooling towers includes a container for receiving water from the cooling water system via a float valve operated float valve. An orifice at the bottom of the container allows water to flow to a device for eliminating suction effects or depression caused by the hydrostatic head of water below the container and a cleaning device, operated by movement of the float valve keeps the orifice clean.

9 Claims, 3 Drawing Sheets

APPARATUS AND METHOD FOR CONTROLLING THE DISCHARGE OR CONTINUOUS BLEED-OFF OF THE COOLING WATER OF EVAPORATIVE COOLERS

BACKGROUND AND BRIEF DESCRIPTION OF THE DRAWINGS

The present invention relates to a method and apparatus for controlling the discharge or continuous bleed-off of water in recirculated systems or circuits, comprised in cooling towers and evaporative coolers used for mechanical refrigeration.

The main objective and purpose of this invention is to obtain a more accurate and reliable control of the discharge or bleed-off of the cooling water than those obtained by means for conventional bleeding, thus by this new way of control there shall be no need of permanent personal attendance and at the same time, avoiding waste or pilferage of water consumption.

It is well known that in all evaporative cooling processes, such as in a water cooling tower and in evaporative condensers, used for mechanical refrigeration, it is unavoidable to provoke the concentration of the solids contained in the recirculated water of the cooling circuit, which, in general, comprise of a plurality of water spray nozzles supplied by the water piped from the discharge of a water recirculating pump, which is collected in a water basin, which has means to replenish water via a valve and has a drain out pipe.

The concentration of solids in the water occurs, except in rare exemptions, because the waters of the public grid of those coming from wells, contain minerals in the form of carbonates, sulfates, etc., and as in the evaporative cooling process a part of the mass of water to be cooled is lost, by evaporation, those minerals contained in the evaporated fraction shall be retained in the rest of the mass of water increasing permanently the concentration of the solids.

This implies that to hold the system on a steady rate it shall be necessary to make-up or replenish the water lost by evaporation, incorporating a new quantity of water which brings its own content of minerals.

In view of this, it's easy to understand that after a certain time in operation, the concentration of solid minerals in the recirculating mass of water will reach extremely high values which shall force termination of operation of the equipment supposed to be cooled.

Some of the inconveniences derived from the excessive concentration of calcium carbonates and other chemical compounds (also known as "hardness"), as as follows:

a) scale build-up on the heat transfer surfaces, b) greater abrasion and wear out of the seals, packings and rotors of the recirculating pumps, c) stoppage or block-up of tubing and piping, of filters, and equipment being served, with danger of stopping all water circulation.

In relation to the calcium carbonate scales mentioned in (a), it is common knowledge of their effect as thermal insulators; thus diminishing the heat transmission and the overall thermal efficiency of the equipment.

In the United States it is common practice not to allow the recirculating water to concentrate any higher than 170 ppm, following the recommendations by ASHRAE (American Soc. Heating Refrig. and Air Conditioning Eng.) for water used in cooling towers and evaporative condensers.

The time it will take to reach these concentrations will depend entirely on the initial hardness of the make-up water.

To hold the concentration within the established limits, it shall be necessary to obtain a continuous dilution of the recirculated water. For a better understanding of the mechanics of the dilution, the following example should be of help:

The make-up for a cooling tower contains 100 ppm of $Ca\ CO_3$; the recirculated water should not contain any higher than 180 ppm; which is the quantity of water make-up required for each lb. of water lost by evaporation:

where, P1 = water lost by evaperation (lbs.)
P2 = excess water required to control concentration (lbs.)
P3 = total make-up water (lbs.)

where, P1 = 1 lb., then, P3 = P1 + P2 therefore, $P3 \times 100\ ppm = (P1 \times 0\ ppm) + (P2 \times 180\ ppm)$ $$P2 = \frac{100}{(180 - 100)} = 1.25\ lb.$$

$$P3 = 1 + 1.25 = 2.25\ lbs.$$

Therefore, if of the 2.25 lbs. make-up which enter the recirculating circuit, 1 (one) lb. is lost by evaporation, the excess of 1.25 lb. must be eliminated by some other means, in a continuous manner, to hold the process in a steady state.

In practice, when the hardness of the make-up water is close or higher that the established limit of concentration, the problem is solved via external chemical treatment or water softening or via internal treatment with additives fed into the recirculating waters.

Therefore, excepting the case when soft water, with zero hardness is used for make-up, there is always a need to provoke the discharge of a fraction of the recirculated water to hold the dilution under control and/or for eliminating the solid matters and residual muds from the chemical treatments and dust precipitated from the air going through the tower.

There are normally two ways to attain the continuous discharge or bleed-off in cooling towers and evaporative condensers:

a) by overflow of the water basin level, b) by diverting to the drain part of the water flowing through the recirculation piping.

The first of the methods mentioned above has been depicted in FIG. 3, shown on a cooling tower, which normally comprises a tube (1) which receives the incoming hot water, with a series of nozzles (2) for spraying water over a heat exchanging surface (3) to attain a heat transfer of heat from the water to a mass of air induced by a fan (4).

The water is collected in a basin (5), which has a pipe (6) for make-up water through a valve 7, controlled by float 8, and a conduit 9 for removing the cooled water by means of pump 10 which delivers to pipe 11 to the recirculating circuit where the cycle is completed returning the heated water back to the nozzles 2. The basin 5 also has a drain pipe 12 into which the overflow pipe 13 is connected to cause the continuous bleed-off of the circuit.

The method just described, for continuous bleed-off, is not advisable because of several reasons, the main one because the water shall continue flowing out of the basin through 13 even after the pump has been stopped, which means a waste of water; another reason is the lack of a precise control of the amount drained on account of the oscillations on the surface of the water in the basin, since as the velocity of discharge is a function of $$\sqrt{2gh},$$

these fractional differences of level can represent large fluctuations of water drained out unnecessarily.

The second method mentioned above, that is, extracting water from the recirculating piping, has been represented in FIG. 4 for a cooling tower similar to the one shown in FIG. 3, and in FIG. 5 for an evaporative condenser.

In the case of FIG. 4, the pipe (1), hot water inlet, is linked with drain 12, via a valve 15 through pipe 14; valve 15 controls the rate of bleed-off of the recirculated system and it's held at an almost constant pressure. In this example, pump 10 delivers through outlet 11 the cold water from the basin 5, when the pump is stopped so shall the bleed-off.

In the case of FIG. 5, which represents an evaporative condenser, the discharge or bleed-off is also controlled by valve 15', installed on pipe 14', which connects pipe 11' coming from pump 10 with the drain pipe 12; here again the valve 15' operates under the hydrostatic pressure as in FIG. 2.

The arrangement described as the second method is perfectly acceptable in practice, as long as the amount of bleed-off is of great magnitude (gpm), otherwise the opening of the valve will be so small that any minor particle or dirt or debris circulating with the water can plug up the flow.

It's opportune to mention that in most large installations there is trained personnel, and sometimes laboratories, in charge of controlling the quality of the make-up water as well as controlling the amount of bleed off. This means that where real help is needed is in small and medium size installations and particularly if the control of the water hardness can be done with a minimum of personal attendance.

The category of small and medium size installation of cooling towers and evaporative condensers falls between the ranges of 100,000 up to 4 million BTU per hour.

In these types of thermal equipment, the heat exchanging takes place with saturated air at about 95 degrees Fahrenheit, at this temperature the latent heat of vaporization is 1039 BTU per lb.

Table 1 shows the quantity of water lost by evaporation for several heat loads and the five columns on the right the corresponding bleed-offs, in GPH (gal. per hour) required to hold a steady concentration of 180 ppm, without the addition of chemicals, using different concentrations of ppm in the make-up water.

TABLE 1

| Thermal Load BTUH | NET EVAPORATION Loss Gal/Hour | Rate of Bleed-off required - Gal/Hour | | | | |
|---|---|---|---|---|---|---|
| | | Hardness 50 ppm | Hardness 75 ppm | Hardness 100 ppm | Hardness 125 ppm | Hardness 150 ppm |
| 100,000 | 11.5 | 4.4 | 8.2 | 14.4 | 26.1 | 57.5 |
| 250,000 | 28.7 | 11.0 | 20.5 | 35.9 | 65.2 | 143.5 |
| 500,000 | 57.5 | 22.1 | 41.1 | 71.9 | 130.7 | 287.5 |
| 1,000,000 | 115.0 | 44.3 | 82.2 | 143.8 | 261.4 | 575.0 |
| 2,000,000 | 230.0 | 88.5 | 164.3 | 287.5 | 522.7 | 1150.0 |
| 4,000,000 | 460.0 | 177.0 | 328.7 | 575.0 | 1045.4 | 2300.0 |

In cooling towers and condensers as those illustrated in FIG. 3 through 5, the average head in the recirculated circuit is 5.00 meters water column. The velocity of discharge through an orifice is $$= c\sqrt{2gh},$$

and the size of the orifice shall be a function of the flow in cubic meters per second to be bleed-off.

For reasons to be explained further on, the Table 2 has been prepared with the orifice sizes required for the continuous bleed-off for the GPH indicated in Table 1. A value of c=0.7 has been assumed to calculate all the orifices.

TABLE 2

| THERMAL Load BTUH | Diameter of the orifices for Bleed-off (inches) | | | | |
|---|---|---|---|---|---|
| | Hardness 50 ppm | Hardness 75 ppm | Hardness 100 ppm | Hardness 125 ppm | Hardness 150 ppm |
| 100,000 | 0.0364 | 0.0496 | 0.0658 | 0.0886 | 0.1314 |
| 250,000 | 0.0575 | 0.0784 | 0.1039 | 0.1400 | 0.2076 |
| 500,000 | 0.0815 | 0.1111 | 0.1473 | 0.1984 | 0.2942 |
| 1,000,000 | 0.1154 | 0.1572 | 0.2086 | 0.2809 | 0.4166 |
| 2,000,000 | 0.1631 | 0.2222 | 0.2948 | 0.3970 | 0.5888 |
| 4,000,000 | 0.2306 | 0.3142 | 0.4169 | 0.5613 | 0.8324 |

As mentioned earlier, the flow, for the bleed-off, is controlled by means of a valve. It's customary to use globe or needle valves for this purpose, therefore the amount of water flow will be defined by the annular opening formed between the valve seat and the conical plunger.

Assuming a cooling tower were using a ½" globe valve and it were necessary to adjust the bleed-off to drain 143.8 GpH (see Table 1 for 1 MM BTUH) with make-up water with 100 ppm), then the free area of the annular section must be equivalent to the cross-section of an orifice of 0.2086" diameter; assuming the diameter of the valve seat were 0.5000", then the conical plunger would have to be introduced until the clearance was 0.0228". It's obvious that even minute particles of dirt will be sufficient to obstruct the pass of the water and consequently provoke an alteration of the GpH blowdown original planned.

In instances when there is a shortage of make-up water or when the hardness is higher than 125 or 150 ppm, it shall be necessary to use chemical products that will modify (increase) the solubility of calcium carbonates in the water; this way you'll lessen the scaling formations on the heat transfer surfaces. For example, holding a concentration of 2.5 ppm of polyphosfate in the recirculating water, for the same load of the above example (1 MM BTUH), with make-up water with 100 ppm, the continuous blow down shall be 64 GPH instead of the 143.8 GPH required with no chemical treatment.

It is frequent to find water which contains 300 ppm and even 600 ppm of hardness; assuming the same load of 1 MM BTUH, with make-up water with 300 ppm, holding the concentration of polyphosfate in 4.5 ppm, the blow down shall be 181 GPH.

The examples mentioned above are proof of how difficult it is to control properly the continuous blow down in a recirculating circuit serving a small or medium size installation, such as cooling towers and evaporative condensers.

The improvements attained with the present invention will allow a more accurate and reliable way of controlling the continuous blow down or bleed-off than the methods in current use, particularly for minimum flows of water.

The here proposed improvements warrant an almost non-clogging condition, a very accurate flow control, and with virtually no attendance required; the cost of the apparatus is very low and it is adaptable to all types of cooling tower and evaporative condensers.

DESCRIPTION OF THE DRAWINGS

The above and other objects, advantages and features of the invention become more apparent when considered with the following specification and accompanying drawings wherein.

DETAILED DESCRIPTION OF THE INVENTION

Figure 1A:
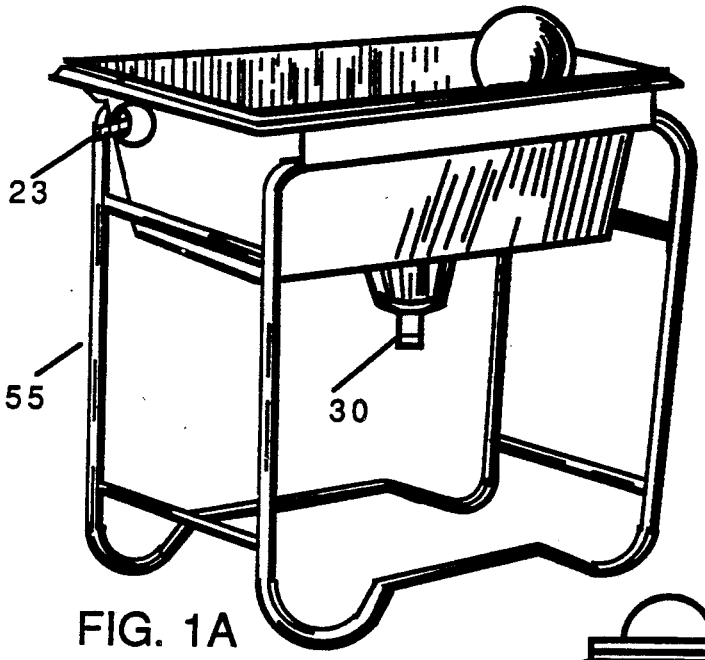
FIG. 1*a* is an isometric perspective view of an apparatus for controlling the continuous bleed-off of cooling water of an evaporative cooler incorporating the invention.

The invention comprises a container 20 which receives water from the recirculating circuit via a pipe 22 and a float valve 24 connected to float 26 by arm 25 to control the level in the container or tank in compensation of the water which continuously drains out of the tank through an orifice 27 placed on the bottom of said tank.

Figure 2:
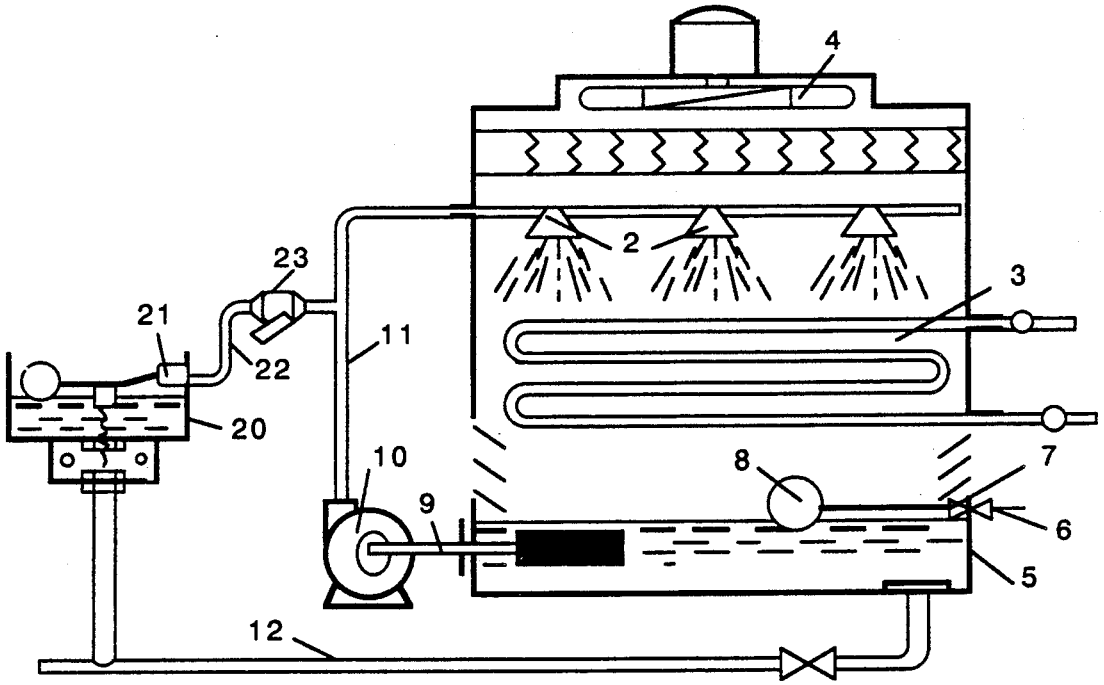
FIG. 2 is a schematic view of the cooling fluid circuit of an evaporative condenser incorporating the invention.
Figure 3:
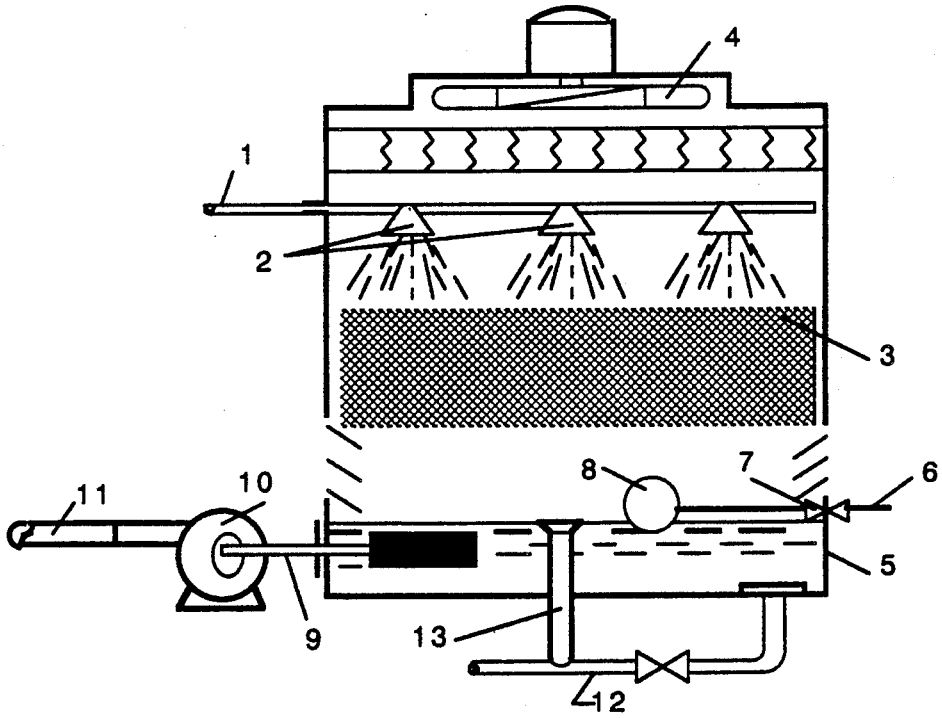
FIG. 3 is a schematic illustration of known or prior art cooling circuit of a cooling tower.
Figure 4:
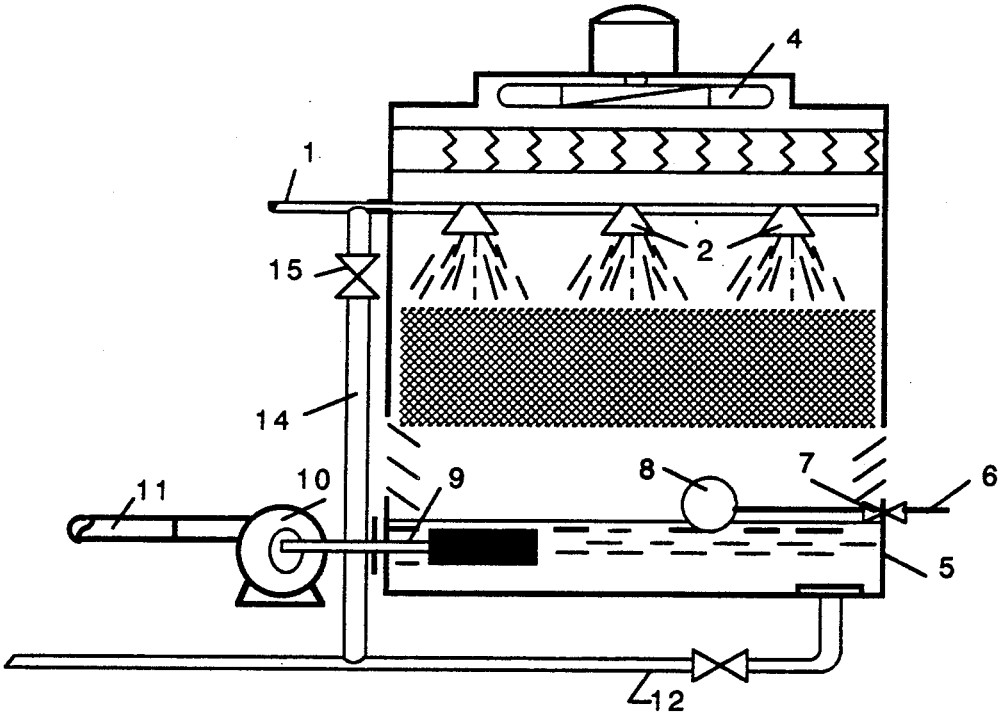
FIG. 4 is a further schematic illustration of a known or prior art cooling circuit of a cooling tower.
Figure 5:
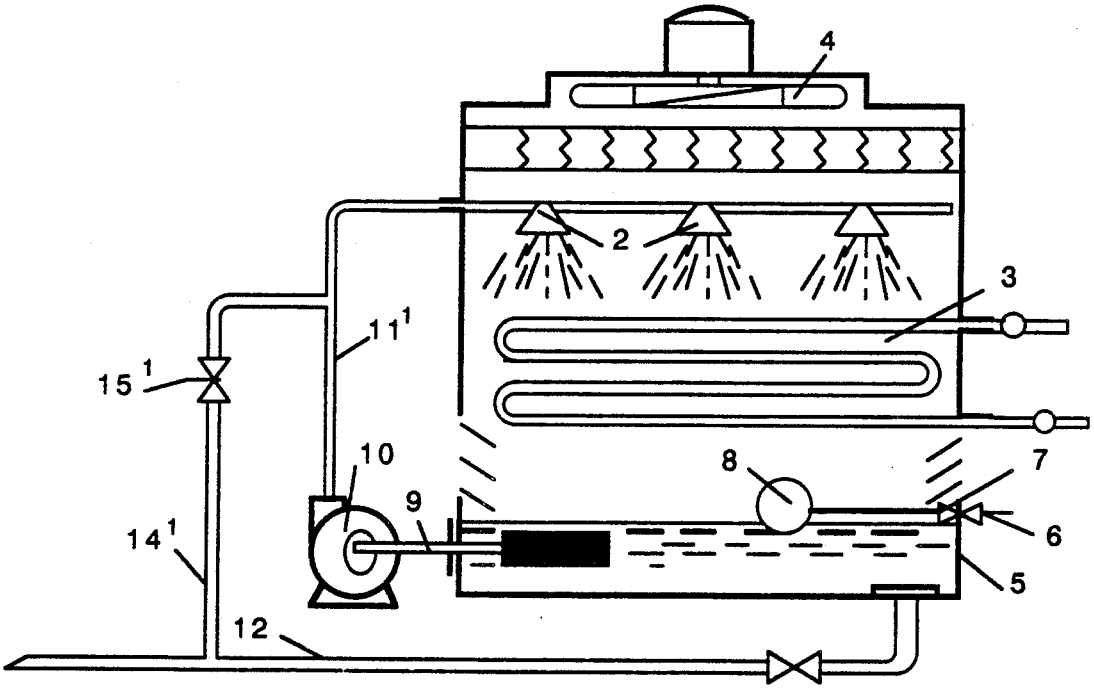
FIG. 5 is a schematic illustration of a known or prior art cooling water circuit for an evaporative condenser.

The water which passes through the orifice 27 is received by a receptacle 28, fixed to the bottom of container or tank 20. The water then is conveyed from receptacle 28 by a vertical tube 30 to the drain pipe 12 of the basin 5 (FIG. 2).

Figure 1C:
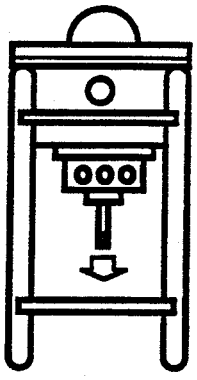
FIG. 1*c* is an end view thereof.
Figure 1B:
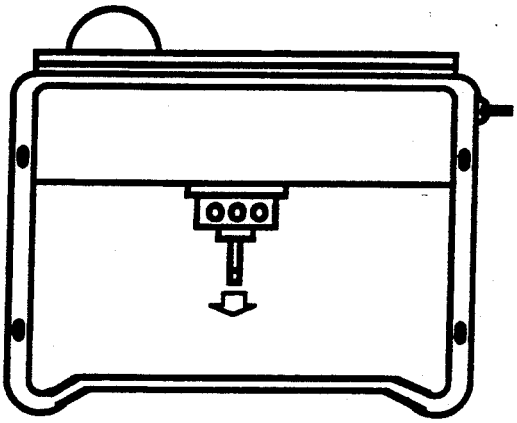
FIG. 1*b* is an side elevations view thereof.

The receptacle has openings 29 on its sidewalls with the purpose of eliminating any suction effects or depression which could be created by the hydrostatic head of the water flowing down the vertical tube on their way to the drain. This arrangement assures that the water inside the tank is unaffected by external forces or pressures by the incoming or outgoing waters. The size of orifice 27' is smaller than pipe 30 so that, as a practical matter, there will be little or no water in receptacle 28 because the water simply flows through the smaller aperture or orifice 27' into the larger pipe 30 which is directly below it. Nevertheless, any water that does collect in the vessel will be below apertures 29 and level with the top of the pipe 30. It will be stagnant water, and of no consequence to the operation of this system. As shown in FIGS. 1*a*, 1*b*, and 1*c*, container 20 and receptacle 28 are supported at a predetermined level by support stand SS. Cover CC may have a bulbous cavity BC formed therein to accommodate the ball float 26.

Finally, the apparatus has cleaner means for removing dirt particles and scale films which could otherwise obstruct or plug the orifice 27' on the bottom of the tank. The cleaner comprises a filament element 31 such as a thread, wire or fine rod, whose top or upper end is connected to the arm 25 of the float valve, and the lower length is introduced into the orifice on the bottom of the tank.

As the continuous blow down shall stop every time the recirculating pump stops, the tank will dry out and it is therefore very probable that when the residual humidity, inside the orifice, drys out, the solids this humidity contained shall leave a fine residual film.

The filament element 31 described above, when the pump is once again started, by virtue of the minute vibrations of the float arm in addition to the oscillations of the water level in the tank shall sense these movements and in turn the filament shall make multiple displacements inside the orifice touching and scraping the contour, thus removing any adhered films or dirt which could dampen the flow of water.

Therefore, the present invention refers to an apparatus for controlling the continuous discharge or bleed-off of water of recirculating circuits, pertaining to cooling towers and evaporative condensers, where said type of circuit comprises one water recirculating pump with its inlet connected to a cold water collecting sump or basin which is part of the lower section of a structure which has means for cooling the recirculated water it receives from a series of spray nozzles which are fed by the recirculating pump, where the collecting sump has means to replenish the water level via a float valve and said sump has a piped connected for draining or emptying it and said drain pipe is the recipient of the continuous bleed-off flowing out of an apparatus described as the present invention.

Figure 1D:
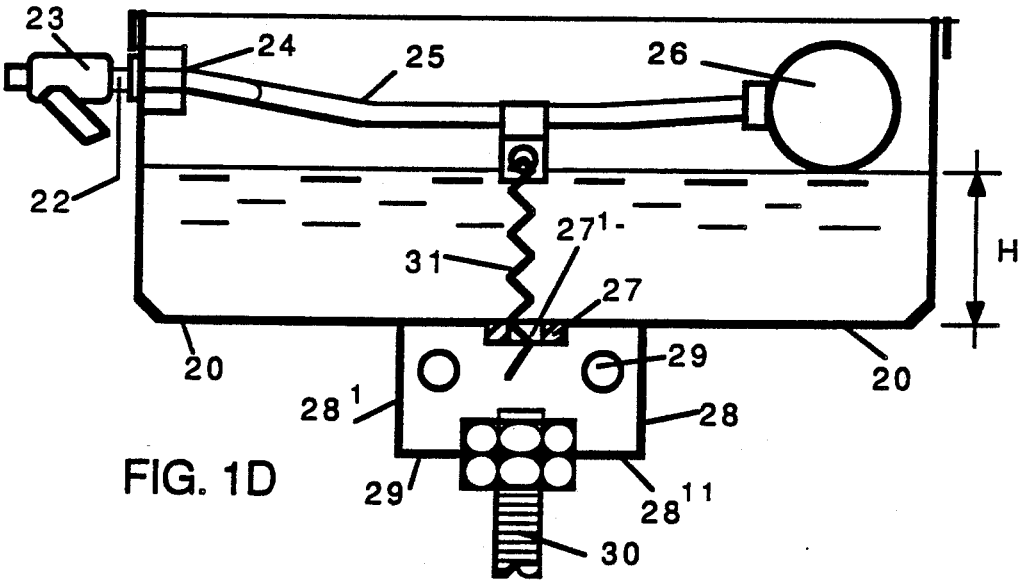
FIG. 1*d* is a schematic sectional view of the apparatus shown in FIG. 1*a*.

With the only purpose of comparing the dimensions of the orifices required in practice, let us assume that the water level "H" in FIG. 1*d*, were 4 inches. On table 3 the diameters are listed for the same BTUH loads used on Table 1 and 2.

TABLE 3

| THERMAL LOAD BTUH | Diameter of the orifices for Bleed-off (inches) | | | | |
|---|---|---|---|---|---|
| | Hardness 50 ppm | Hardness 75 ppm | Hardness 100 ppm | Hardness 125 ppm | Hardness 150 ppm |
| 100,000 | 0.0963 | 0.1312 | 0.1739 | 0.2336 | 0.3475 |
| 250,000 | 0.1523 | 0.2074 | 0.2750 | 0.3694 | 0.5496 |
| 500,000 | 0.2153 | 0.2932 | 0.3888 | 0.5223 | 0.7769 |
| 1,000,000 | 0.3045 | 0.4147 | 0.5499 | 0.7386 | 1.0988 |
| 2,000,000 | 0.4307 | 0.5866 | 0.7778 | 1.0448 | 1.5542 |
| 4,000,000 | 0.6091 | 0.8296 | 1.0999 | 1.4775 | 2.1979 |

Notice that, for example, for 4MM BTUH and 150 ppm this orifice has to be 2.1979" diameter. Compare this with Table 1, where the orifice require is 0.8324".

As the cross-sections vary as the square of the diameters, the actual ratio of free areas is:

$$\frac{(2.1979)^2}{0.8324} = 7 \text{ to } 1 \text{ (larger)}$$

While there has been shown and described a preferred embodiments of the invention, it will be appreciated that various other adaptations and modifications of the invention will be readily apparent to those skilled in the art and it is intended to encompass such obvious modifications and adaptations in the spirit and scope of the claims appended hereto.

What is claimed is:

1. Apparatus for controlling the discharge of water in recirculating circuits of cooling towers and evaporative coolers having a water collection basin having a drain therein, comprising:

a container having sidewalls and a bottom wall, valve means connecting said container to said recirculating circuit to receive water therefrom and supply same to said container, means for controlling said valve means to control the level H of water in said container and without overflowing said sidewalls, a receptacle positioned below said container and means forming an orifice of predetermined size in said bottom wall between said container and said receptacle to permit water to flow from said container to said receptacle, and vertical passage means connecting said receptacle with said drain to gravity feed water from said receptacle.

2. The apparatus defined in claim 1 including means for eliminating suction effects or depression created by any hydrostatic head of water flowing through said vertical passage means.

3. The apparatus defined in claim 1 including means for mechanically cleaning said orifice as water flows therethrough.

4. The apparatus defined in claim 3 wherein said means for controlling said valve means includes a float on the surface of water in said container and an arm connecting said float with said valve, and said means for cleaning said orifice includes an elongated cleaning member passing through said orifice and connected to said arm, said elongated cleaning member being moved back and forth in said orifice to remove scale therefrom and maintain the said predetermined size of said orifice.

5. A method of controlling the discharge of water in the recirculation system of cooling towers and evaporative coolers, having a water collection basin and a drain in said basin, comprising:

maintaining a constant body of said water in a separate container remote from said basin and having an orifice of predetermined size in the bottom thereof, gravity draining water from said container through said orifice to a receptacle, and then through a vertical passage to said drain, continuously mechanically cleaning said orifice to maintain the predetermined size of said orifice, and eliminating suction effects and/or depression created by any hydrostatic head of water flowing through said vertical passage.

6. A system for controlling the discharge of water in recirculating circuits of cooling towers and evaporative coolers having a water collection basin having a drain therein, comprising:

a control container, valve means connecting said control container to said recirculating circuit to receive water therefrom and supply same to said control container, means forming an orifice of predetermined cross-sectional area in said control container to permit water to flow from said control container, means including said valve means for controlling the height H of water in said container above said orifice, vertical passage means connecting said orifice with said drain to gravity feed water from said orifice container to said drain, means for controlling including said valve means includes a float on the surface of water in said control container and an arm connecting said float with said valve, and means for continuously cleaning said orifice including an elongated cleaning member passing through said orifice and connected to said arm, said elongated cleaning member being moved back and forth by movement of said float arm in said orifice to remove scale therefrom and maintain the said predetermined size of said orifice.

7. Apparatus for controlling the blow down of water in the recirculation system of cooling towers and evaporative coolers having a water collection basin and a drain connected to said basin, a separate remote container having bottom and sidewalls with top edges, an orifice of predetermined size in said bottom, valve means connecting said separate container to said recirculation system and means for controlling said valve means so as to maintain a body of water in said separate container at a height H above said orifice and below the top edges of said sidewalls, means for maintaining water in said separate container at said height H above said orifice.

8. In an apparatus for controlling the blow down of water in the recirculation system of cooling towers and evaporative coolers, having a water collection basin and a drain connected to said basin, comprising: a separate container having a bottom, means for maintaining a body of said water in said separate container, said separate container having an orifice of predetermined size in the bottom thereof, means for maintaining said body of water at a height H above said orifice, whereby water drains from said container through said orifice at a fixed rate and a vertical passage connected to said drain, means for eliminating suction effects and/or depression created by an hydrostatic head of water flowing through said vertical passage, the improvement wherein said separate container has sidewalls greater in height than H and is adapted to be remotely located relative to said basin.

9. The apparatus defined in claim 8 including water operated mechanical means for continuously cleaning said orifice to maintain the predetermined size of said orifice.

* * * * *